US006578723B1

(12) United States Patent
Tyner

(10) Patent No.: US 6,578,723 B1
(45) **Date of Patent: *Jun. 17, 2003**

(54) FLEXIBLE SEALING COVER WITH SEAL BREAK INDICATOR

(75) Inventor: Clifford A. Tyner, Grass Valley, CA (US)

(73) Assignee: Pharmacy, Inc., Boca Raton, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 502 days.

This patent is subject to a terminal disclaimer.

(21) Appl. No.: 08/865,828

(22) Filed: May 30, 1997

(51) Int. Cl.[7] ..... B65D 39/00

(52) U.S. Cl. ..... 215/232; 215/254; 220/359.2; 220/359.3; 220/359.4

(58) Field of Search ..... 215/232, 254, 215/249; 220/359.2, 359.3, 359.4

(56) References Cited

U.S. PATENT DOCUMENTS

| | | | | |
|---|---|---|---|---|
| 300,854 A | | 6/1884 | Dexter | |
| 1,916,977 A | | 7/1933 | Gutmann | |
| 2,373,847 A | | 4/1945 | Osborne et al. | |
| 2,876,775 A | | 3/1959 | Barr, Sr. et al. | |
| 3,064,652 A | | 11/1962 | Corcoran et al. | |
| 3,391,847 A | | 7/1968 | Christine et al. | |
| 3,463,339 A | | 8/1969 | McGuckin | |
| 3,501,042 A | | 3/1970 | Risch et al. | |
| 3,637,102 A | | 1/1972 | Shaw | |
| 3,712,498 A | | 1/1973 | Lawrence | |
| 3,788,374 A | | 1/1974 | Saijo | |
| 3,904,060 A | | 9/1975 | McPhee | |
| 3,921,630 A | | 11/1975 | Baldwin | |
| 4,006,839 A | | 2/1977 | Theil et al. | |
| 4,131,211 A | | 12/1978 | Corbic | |
| 4,209,126 A | | 6/1980 | Elias | |
| 4,266,687 A | | 5/1981 | Cummings | |
| 4,318,490 A | | 3/1982 | Schneider | |
| 4,390,104 A | | 6/1983 | Cummings | |
| 4,394,917 A | * | 7/1983 | Looser | 215/232 |
| 4,396,655 A | * | 8/1983 | Graham et al. | 215/232 X |
| 4,418,834 A | * | 12/1983 | Helms et al. | 215/232 X |
| 4,423,819 A | | 1/1984 | Cummings | |
| 4,514,248 A | | 4/1985 | Cummings | |
| 4,527,703 A | | 7/1985 | Cummings | |
| 4,550,842 A | | 11/1985 | Cummings | |
| 4,598,834 A | | 7/1986 | Singletary, Jr. | |
| 4,915,289 A | * | 4/1990 | Hatano et al. | 220/359.4 X |
| 5,395,005 A | * | 3/1995 | Yoshida | 220/359.2 |
| 5,702,015 A | * | 12/1997 | Giles et al. | 215/232 |

* cited by examiner

*Primary Examiner*—Stephen K. Cronin
(74) *Attorney, Agent, or Firm*—Israel Nissenbaum

(57) ABSTRACT

A sealing cover includes an upper cover member which is impervious to bacteria and moisture, and is attached to an annular ring member, also impervious to bacteria and moisture. The upper cover member and annular ring member are attached to each other by means of an adhesive which, when the upper cover member is detached from the annular ring member, leaves substantially no visible indication of adhesive residue on the annular ring member, while losing its adhering properties. Another layer of adhesive is provided on the bottom of the annular ring for attaching the sealing cover to the rim of the opening of a container such as an I.V. container, in a non-removable manner such that the upper cover member can be removed without removing the annular ring member from the rim of the container to which it is attached.

5 Claims, 2 Drawing Sheets

FLEXIBLE SEALING COVER WITH SEAL BREAK INDICATOR

BACKGROUND OF THE INVENTION

This invention relates to an apparatus and method for resealing a sterilized container, and more particularly, to a sterile seal for resealing the container after the original seal is broken and for providing an indication on the rim of the container top that the seal has been removed.

In many hospitals, intravenous (I.V.) additive programs are administered as a way of introducing medication into a patient. Typically, a drug which is prescribed by a doctor, is added to an intravenous solution. The medication is added into an I.V. bottle under sterilized conditions by inserting a needle into a target area rubber membrane which closes the top of the I.V. solution bottle or container.

Such bottles or containers typically have a sterile seal covering a membrane area, typically a rubber membrane, until the medication is to be added. The medication is added after removal of the seal, and penetration of the membrane with a medication administering needle. The container must then be resealed under sterilized conditions to prevent airborne bacteria from accumulating on the exposed upper surface of the I.V. container top. By resealing the container, the hospital staff is also alerted that the contents have been altered. In operation, the staff will not administer the I.V. solution unless they mix the contents themselves, or there is some means to alert the staff that the contents have not been altered since its preparation with the added medication.

In the past, plastic caps have been utilized for resealing such I.V. containers. Such caps typically snap over the top of the metal rims surrounding the rubber membrane to completely seal the top of the solution bottle. The problem with this approach has been that since the I.V. solution and containers manufactured by different manufacturers have tops which are not of uniform diameter, the plastic caps do not always provide the necessary sterilized seal in resealing the I.V. container.

One prior art approach to solving the problems inherent in the use of plastic caps has involved forming a seal out of a combination of materials and bonding systems. Typically, such seals involve an impermeable upper layer such as polypropylene, and a non-adhesive surface to cover the rubber membrane target area of the container top. A self-destructing adhesive layer has been included in the laminated structure and arranged to form an annular ring surrounding the circular target area to have the adhesive material adhere tightly to the metal ring surrounding the rubber membrane target area. Any removal of the seal then left a telltale strip of material affixed to the metallic rim from the self-destructing adhesive, which indicated to hospital staff that the seal has been previously broken. The presence of the telltale material on the rim of the cap was intended to reduce the chance of someone removing the seal, allowing the top to become contaminated and resealing the container with that seal or a new seal so that it would appear to staff to be in sterilized condition.

A disadvantage with type of system is, however, that the adhesive layer due to its self destructing nature, leaves a messy residue on the rim and potentially on the rubber membrane. A further disadvantage is that a leaving a residue of adhesive material, although allegedly self-destructing, may still retain some adhesive quality allowing resealing of the container either with the old seal or with a new seal, and thus allowing circumvention of its indicating feature. In fact, due to the nature of this design, incomplete delamination may often occur, leaving the target membrane partially blocked.

An alternative approach to this type of seal has involved providing a similar sealing cover which includes slits formed in the cover to promote its tearing to leave telltale sealing strips on the container upon removal of the cover. The problem with this type of arrangement, however, is that it relies on tearing of the cover in a very precise manner, which in turn requires very expensive process control conditions in the manufacturing of the seals to ensure that proper tearing occurs so that the seal can be used in the manner intended. Further, by leaving telltale strips, resealing with a second seal may result in an imperfect seal, resulting in bacterial contamination.

In accordance with this invention, the problems of the prior art plastic caps and the multiple layer seals are avoided, while providing an easily used seal which provides a clear indication upon removal to prevent its reuse to reseal the container with which it is employed.

SUMMARY OF THE INVENTION

In accordance with one aspect of the invention, there is provided a sealing cover for resealing a membrane of a container in a sterile manner. The sealing cover includes an upper, substantially impermeable to moisture and bacteria, cover member. A first adhesive layer is arranged in a ring shape on the bottom of the cover member for adhering the cover member to an annular ring member made of substantially impermeable moisture and bacteria material. A second adhesive layer is disposed on the bottom of the annular ring member for adhering the annular ring member to the rim of the container for sealing the membrane of the container in a sterile manner.

The first adhesive layer is such that, upon separation of the upper cover member from the annular ring member, substantially no visible indication of adhesive residue is left on the annular ring member, or on the upper cover member. The first adhesive layer also loses its adhesive properties upon the separation of the upper cover member. The second adhesive layer is such that when the upper cover member is separated from the annular ring member, the annular ring member is held securely on the rim of any container to which the annular ring member has been attached.

In this manner, contrary to the prior art, the seal is effectively destroyed by leaving half the seal, i.e., the annular ring member is held securely on the rim of any container with which it is used. Thus, this serves as a visual indicator to anyone attempting to reseal the container with a new seal, or with the other seal, since the first adhesive is such that when separated, loses all of its adhesive properties, and at the same time, the annular ring member retained on the rim serves to indicate that resealing should not be attempted.

In a more preferred aspect, a pull tab is connected to and extends from the upper cover member. The upper cover member is preferably made of metalized Mylar, a registered trademark for a polyester film materal, a polyester based material commercially available from Dupont Corporation, and the annular ring member is preferably made of clear Mylar. Although Mylar material has been indicated as preferred, other polyester based alternatives available commercially can be substituted in place thereof. The first adhesive layer is typically UV cured varnish, with the second adhesive layer being a pressure sensitive adhesive, i.e., an adhesive that is not easily removed.

In another aspect, the invention is directed to a strip of carrier liner having a plurality of sealing covers removably carried thereon. The liner is a base liner layer, and includes a plurality of sealing covers of the type previously described. The base liner is made of a material which allows removal of each sealing cover intact with the second adhesive layer thereon without substantially effecting the adhesive properties of the second adhesive layer.

In yet still another aspect, there is provided a method of resealing the top of a solution bottle having a rim and a pierceable membrane covering the opening of the bottle inside the rim. The method involves forming an upper, substantially impermeable to moisture and bacteria, cover member. A first adhesive layer is disposed in a ring shape on the bottom of the upper cover member and an annular ring member, made of substantially impermeable to moisture and bacteria material, is joined to the upper cover member through the first adhesive layer. The first adhesive layer is such that the upper cover member can later be separated from the annular ring member, leaving substantially no visible indication of adhesive residue on the annular ring member. A second layer of adhesive is disposed on the bottom of the annular ring member for adhering the annular ring member to the rim of the container. The second layer of adhesive is such that when the annular ring is attached to the rim, and the upper cover member is attached to the annular ring, the upper cover member can be detached therefrom without detaching the annular ring member from the rim. The upper cover member, first adhesive layer, annular ring member and second adhesive layer are joined to form an integral laminated cover for use as a sealing cover. The cover is then attached to a strip of carrier liner, sterilized and packaged to maintain sterility prior to use, and thereafter the cover is removed from the liner and applied to the top of the bottle with the second adhesive layer in contact with the rim at the opening of the bottle.

BRIEF DESCRIPTION OF THE DRAWINGS

Having briefly described the invention, the same will become better understood from the following detailed discussion taken in conjunction with the drawings, in which.

DETAILED DISCUSSION OF THE INVENTION

Figure 1:
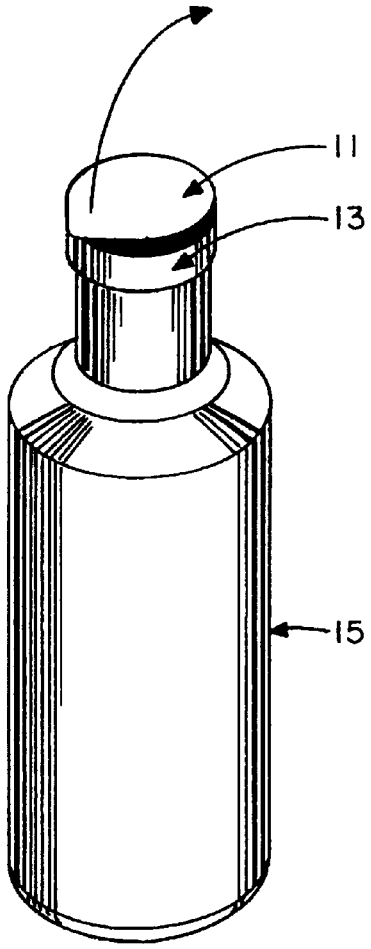
FIG. 1 is a perspective view of a, for example, I.V. solution container resealed with the seal of the present invention.

FIG. 1 illustrates a sealing cover 11 of the invention, resealing the top of a container 15 at an opening neck 13 thereof. A pull tab 19 is provided to allow pulling on the sealing cover 11 to remove it from the neck 13 of the container 15 opening.

Figure 2:
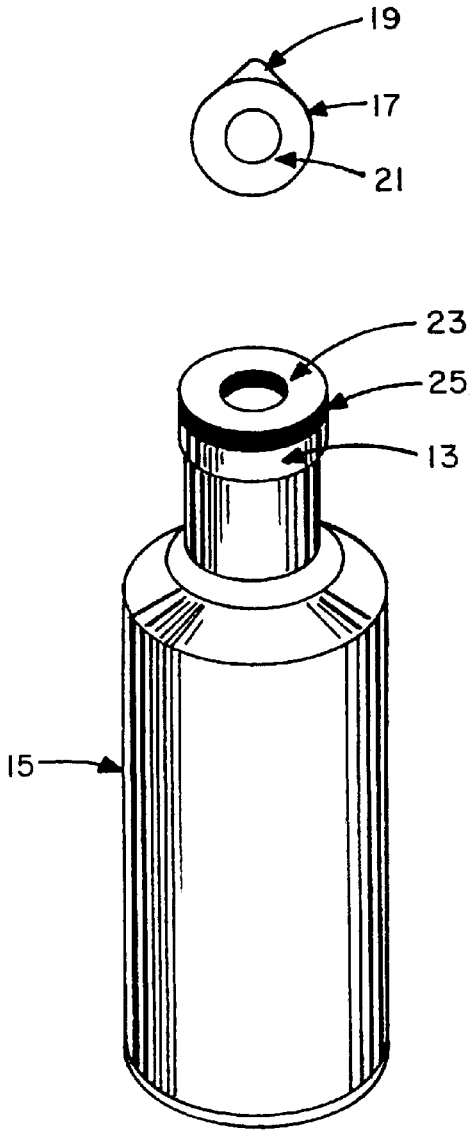
FIG. 2 is a perspective view of the I.V. solution container of FIG. 1, and illustrates the annular ring member adhering to the metal rim of the solution container upon removal of the upper cover member.

FIG. 2 illustrates the container 15, typically but not limited to an I.V. container, and upper cover member 17 of the sealing cover 11 after the upper cover member 17 has been removed. FIG. 2 also illustrates the bottom portion of the sealing cover 11 made up of an annular ring 23 adhered to the rim of the neck 13 of the opening of the container 15. The upper cover member 17, when removed, destroys adhesive layer 21 leaving the top surface of annular ring 23 with substantially no visible indication of adhesive residue, and serving as an indicator to users that the container 15 is not to be resealed, and preventing reattachment of the upper cover member 17 due to the fact that the adhesive layer 21, when the upper cover member 17 is removed, degrades and loses its adhesive properties, leaving no visible indication of adhesive residue remaining.

A second layer of adhesive 25 secures the annular ring 23 to the rim of the neck 13 of the opening of the container 15 in a manner which prevents detachment of the annular ring 23 when the upper cover member 17 is removed by pulling on pull tab 19. The solution container 15 illustrated in FIG. 2 is now ready by a nurse or other hospital staff member to insert a needle through the rubber membrane target area of these types of containers, which has been kept sterile by the sealing cover 11 to administer, for example, an IV solution to a patient.

Figure 3:
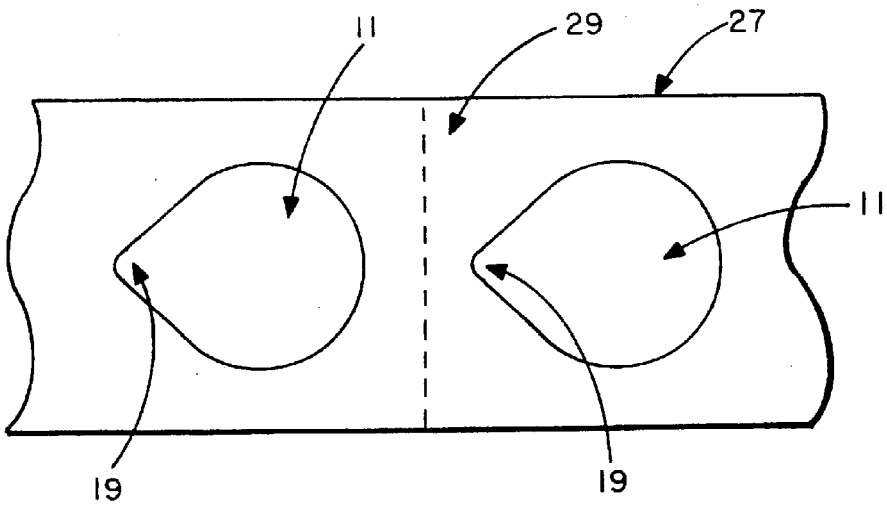
FIG. 3 is a top view of two sealing covers packaged on a strip of carrier liner.

FIG. 3 is a top view of two sealing covers 11 packaged upon a strip of carrier liner 27, which is coated with a material to allow adhesive 25 on annular ring 23 to adhere to the liner 27 for easy removal without destroying the adhesive layer 25. Typically, the adhesive layer 25 is a pressure sensitive adhesive, which, when the annular ring 23 is attached to the rim of the container 15, does not easily allow removal of the ring 23 and serves to secure the ring 23 in very tight engagement with the rim. The sealing cover 11 may then be easily removed from the liner 27 by grasping the pull tab 19 which is not affixed to the liner 27. The sealing cover 11 is packaged upon a strip of the carrier liner 27 may be rolled and placed in a flat cardboard container for dispensing individual ones of the sealing covers 11. Sealing covers 11 require significantly less space than that required for the prior art molded plastic resealing caps.

Figure 4:
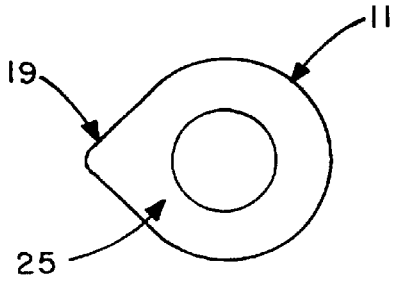
FIG. 4 is a bottom view of the sealing cover of the invention after removal from the strip of carrier liner.

FIG. 4 is a bottom view of the sealing cover 11 after removal from a carrier liner 27, illustrating the adhesive layer 25 on the annular ring 23 (not shown). As may be appreciated, the center of the upper cover member 17 on the underside thereof is free of adhesive as the only adhesive layer is a ring shaped layer 21 which is typically a UV cured varnish, which allows easy removal of upper cover member 17 from annular ring 23, and with substantially all visible indication of the adhesive 21 being removed from annular ring 23. This adhesive 21, by virtue of removal from annular ring 23, degrades and loses it's adhesive properties.

Figure 5:
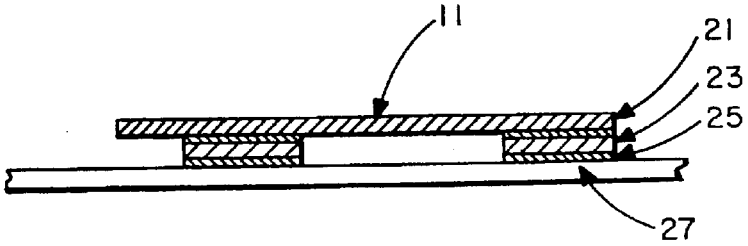
FIG. 5 is a side cross-sectional view of a sealing cover assembled on a carrier liner.

FIG. 5 illustrates a laminated structure of the preferred embodiment of the sealing cover 11. In this preferred embodiment of the sealing cover 11, a continuous strip of metalized Mylar, a registered trademark for, polyester based material commercially available from Dupont Corporation, is used to form a bacteria and moisture impermeable upper cover member 17. Metalized Mylar refers to the surface finish on the Mylar film. The finish gives the surface the appearance of a polished metal, and as indicated previously, it and its equivalents are readily commercially available. The upper cover member 17 is joined by the adhesive layer 21 to a continuous layer structured as an annular ring 23, preferably made of clear Mylar film, which is non-colored and transparent, and which is also moisture and bacteria impermeable. The adhesive layer 21 is preferably a UV cured varnish which, when upper cover member 17 is removed from annular ring 23, degrades and loses its adhesive properties while leaving substantially no visible indication of adhesive residue on the upper surface of the annular ring 23. The adhesive layer 25 easily detaches from the coated carrier liner 27 and is typically a pressure sensitive adhesive which, when used to attach the sealing cover 11 through ring 23 to the rim of a container 15, does not allow the annular ring 23 to be easily removed from the container 15, even when the upper cover member 17 is separated from the annular ring 23.

Of course, the upper cover member 17 and annular ring 23 of the present invention are not limited to the particular materials or arrangement of materials forming the laminated structure illustrated in FIG. 5 as described. The invention may alternatively be implemented by an arrangement and selection of different materials and bonding systems which achieve the effects described as will be readily apparent to those of ordinary skill in the art.

Other types of materials which can be used for the upper cover member 17 and annular ring 23 include other plastic or metal films such as polyolefin, acrylic, polyester or aluminum foil, or laminates of such materials, in a conventional manner, as will be readily apparent to those of ordinary skill in the art. With respect to adhesive layer 21, although a UV cured varnish is preferred, any cured type of adhesive would suffice, as will be readily apparent to those of ordinary skill in the art, and are well known materials. In an alternative as the adhesive layer 21, one can use a hot met, cyanoacrylate, or a two part adhesive (one layer as a pressure sensitive adhesive attached to upper cover member 21 and a conventional chemical agent on annular ring 23 which is used to break dawn the adhesive on upper cover member 21), as will be readily apparent to those of ordinary skill in the art.

With respect to sizes and shapes, various such sizes and shapes can be manufactured to accommodate a variety of vial and bottle cap sizes, and plastic bag ports. In terms of dimensions, it is noted that it is preferred that the upper cover member 17 be approximately 0.002 inches in thickness or depth, and the annular ring 23 should be approximately 0.001 inches in thickness or depth. These thicknesses are illustrative only and may change depending on materials selected.

Preferably, the sealing cover 11 is manufactured under clean conditions and attached to a treated carrier liner 27 for retaining the sterility of the sealing cover 11. The strip of liner 27 is rolled and placed in a dispenser box and then placed in plastic bags, and the bags containing the packaged seals are then sterilized by using appropriate sterilization agents such as ethylene oxide gas. The carrier liner may also be perforated by perforations 29, as shown in FIG. 3, to facilitate removing a group of seal covers, or to remove a "used" strip of the liner 27.

In use, the original sealing cover for a container installed by the manufacturer of the container is removed by a pharmacist or other hospital technician under appropriate procedures for maintaining sterile conditions. Medication can then be added to the container 15 under a sterile hood or other sterile environment. The membrane of the opening of the container 15 (not shown or numbered) may be penetrated with an appropriate needle and a controlled quantity of drugs or medication released into the solution in the container 15. A sealing cover 11 can then be peeled from the carrier liner 27 using the tab 19. In this manner, the sealing cover 11 is maintained sterile and annular ring 23 with adhesive 25 is then aligned with the rim of the neck 13 of the container 15 and forced into contact with the rim by gentle pressure to ensure a proper seal.

Coding information can be applied to the upper cover member 17 such as information indicating the identity of drugs in the solution or other information as may be desirable.

The sterile seal 11 of the resealed container 15 is not broken until it is time to administer the additive solution to a patient. The sealing cover 11 can have the upper cover member 17 easily removed by hand without using pliers by simply pulling on the tab 19. The clean annular ring 23 remaining provides an indication that the sterile seal has been broken and prevents resealing of the container. Thus, once the sealing cover 11 upper cover member 17 is removed, a needle, for example, in an I.V. "piggyback" arrangement, can be inserted through the rubber membrane of the opening of the container 15 to complete appropriate connections for administering to a patient.

Although the preferred embodiments of the invention have been illustrated in accompanying drawings and described in the previous description, it will be understood that the invention is not limited to the embodiments disclosed and is capable of numerous variations, modifications and substitution of elements without departing from the spirit of the invention.

What is claimed is:

1. A sealing cover strip for covering of a membrane of a container in a sterile manner and as a visual indication of removal of the cover strip from the membrane and loss of sterility thereof, with said container having an opening with a rim, and wherein said membrane is positioned within said opening to close said opening, with said cover strip comprising:

an upper strip member which is substantially impermeable to moisture and bacteria;

a first adhesive layer, in a ring shape, on the bottom of said strip member, for adhering said strip member to an annular ring member strip made of a material substantially impervious to moisture and bacteria;

a second adhesive layer on the bottom of said annular ring member strip for adhering said annular ring member strip to the rim of said container for sealingly covering the membrane of the container in a sterile manner; and said first adhesive layer being adapted wherein upon separation of said upper cover member from said annular ring member, the first adhesive layer loses substantially all adhesive properties on said annular ring member, and wherein said second adhesive is adapted such that when said upper cover member is removed, said annular ring member is held securely on the rim of any container to which said annular ring member has been attached, to thereby provide visual indication of removal of the cover strip from the membrane and loss of sterility thereof, wherein said first adhesive layer is UV cured varnish and said second adhesive layer is pressure sensitive adhesive.

2. A sterile sealed container comprising an opening with a rim, a membrane positioned within said opening to effect a closing of the container with a sterile seal, and a protective sealing cover strip for covering the membrane of the container in a sterile manner, with said cover strip comprising visual indicating means of removal of the cover strip from the membrane and loss of sterility thereof, with said cover strip comprising:

an upper strip member which is substantially impermeable to moisture and bacteria;

a first adhesive layer, in a ring shape, on the bottom of said upper strip member, for adhering said upper strip member to an annular ring member strip comprised of a material substantially impervious to moisture and bacteria:

a second adhesive layer on the bottom of said annular ring member strip for adhering said annular ring member strip to the rim of said container for sealingly covering the membrane of the container in a sterile manner;

wherein said first adhesive layer is adapted such that upon separation of said upper strip member from said annular ring member strip, the first adhesive layer loses substantially all adhesive properties on said annular ring member strip, and wherein said second adhesive layer is adapted such that when said upper strip member is removed, said annular ring member strip is held securely on the rim of the container to which said annular ring member has been attached, to thereby provide visual indication of removal of the cover strip from the membrane and loss of sterility thereof.

3. The sterile sealed container of claim 2, wherein the sealing cover strip further comprises a pull tab connected a from said upper strip member.

4. The sterile sealed container of claim 2, wherein said Upper strip member is made of metalized polyester based material and said annular ring member strip is made of cleat polyester based material.

5. The sterile sealed container of claim 2, wherein said upper strip member is about 0.002 inches in thickness and said annular ring member strip is about 0.001 inches in thickness.

* * * * *